US005115555A

United States Patent [19]

Olsson et al.

[11] Patent Number: 5,115,555

[45] Date of Patent: May 26, 1992

[54] APPARATUS FOR MANIPULATING A HIGH DENSITY FLAT CABLE

[75] Inventors: Billy E. Olsson, New Cumberland; Iosif Korsunsky, Harrisburg, both of Pa.

[73] Assignee: AMP Incorporated, Harrisburg, Pa.

[21] Appl. No.: 659,787

[22] Filed: Feb. 22, 1991

[51] Int. Cl.[5] ..... H01R 43/00

[52] U.S. Cl. ..... 29/566.3; 29/749

[58] Field of Search ..... 29/33 M, 566.3, 566.1, 29/566.2, 564.4, 749, 751, 759

[56] References Cited

U.S. PATENT DOCUMENTS

| | | | |
|---|---|---|---|
| 3,696,319 | 10/1972 | Olsson | 339/17 F |
| 4,091,531 | 5/1978 | Grubb et al. | 29/749 |
| 4,290,179 | 9/1981 | Bakermans et al. | 29/33 M |
| 4,326,764 | 4/1982 | Asick et al. | 339/14 R |
| 4,344,225 | 8/1982 | Johnson, Jr. et al. | 29/857 |
| 4,525,927 | 7/1985 | Guerout et al. | 29/861 |
| 4,566,164 | 1/1986 | Brown et al. | 29/33 M |
| 4,584,757 | 4/1986 | Aldon et al. | 29/566.3 X |
| 4,589,200 | 5/1986 | Burgit et al. | 29/753 |
| 4,630,362 | 12/1986 | Bauer et al. | 29/751 |
| 4,633,570 | 1/1987 | Burgit et al. | 29/564.4 |
| 4,709,473 | 12/1987 | Shields | 29/749 |
| 4,741,099 | 5/1988 | Olsson | 29/749 |
| 4,742,746 | 5/1988 | Olsson | 83/387 |
| 4,749,371 | 6/1988 | Hirai et al. | 439/497 |
| 4,879,809 | 11/1989 | Nicholas et al. | 29/759 X |
| 4,928,379 | 5/1990 | Paquin et al. | 29/566.3 |

FOREIGN PATENT DOCUMENTS

| | | | |
|---|---|---|---|
| 57060 | 8/1982 | European Pat. Off. | 29/749 |
| 154387 | 9/1985 | European Pat. Off. | 29/749 |

*Primary Examiner*—William Briggs
*Attorney, Agent, or Firm*—Bruce J. Wolstoncroft

[57] ABSTRACT

An apparatus for terminating conductors of a ribbon cable to a dielectric housing has a movable frame member and a stationary frame member. The movable frame member has a laminated subassembly and a staking block provided thereon. A support member is positioned on the movable frame member and is movable between a first position and a second position. In the first position, the support member cooperates with the staking block to insure that the staking block is not movable relative to the movable frame member. This allows the staking block to coin or deform top walls of recesses of the dielectric housing. Alternatively, when the support member is in the second position, the support member does not cooperate with the staking block, thereby allowing the staking block to move relative to the movable frame.

19 Claims, 14 Drawing Sheets

APPARATUS FOR MANIPULATING A HIGH DENSITY FLAT CABLE

FIELD OF THE INVENTION

The invention is directed to an apparatus which assists in the termination of a high density cable to a high density connector In particular, the apparatus cooperates with the individual conductors of the cable to ensure that the cable is accurately positioned and maintained as the cable is terminated to the connector, thereby providing a positive electrical connection therebetween

BACKGROUND OF THE INVENTION

There are numerous connectors currently available which terminate flat flexible cable. The majority of these connectors operate effectively to terminate ribbon cable which has sufficient spacing provided between the conductors. However, a problem arises when the spacing between the conductors is reduced. In particular, when the spacing between the conductors is in the range of 0.5 mm 0.0197 inches), molding the dividers between the conductors or contacts becomes impractical. When the thickness of the dividers are required to be less than 0.010 of an inch some dividers simply do not fill, resulting in the possibility of shorting of the adjacent conductors or contacts.

U.S. Patent application 07/502.941, filed Mar. 30, 1990, discloses an electrical connector in which the spacing of the terminals does not depend upon the molding tolerances of the connector. The connector has a recess positioned in a housing. A plurality of terminals are positioned in the recess. The terminals have retention portions with sharp outer edges which cooperate with securing means of the housing to position and maintain the terminals within the recess. As the terminals are inserted into the recess, the sharp outer edges cooperate with the securing means to displace portions of the securing means, thereby securing the terminals in the connector The referenced patent application also discloses a method and apparatus for positioning a prepared end of the cable into cooperation with an alignment bar. A conductor driving member and conductor support member are moved into cooperation with the conductors A lead projection of the conductor support member engages the conductors of the cable. The lead projection is positioned in the cavity of the alignment bar. This ensures that the lead projection cooperates with the individual conductors to the cable, to maintain them in position in their respective conductor receiving recess. The force required for the lead projection to retain the cable in place is generated by the spring member associated with the lead projection.

The method described is sufficient in particular applications, however in many instances the lead projection does not have a significant force associated therewith. Consequently, in many instances a positive electrical connection can not be assured, and the spacing of the conductors is not reliable.

It would therefore prove advantageous to provide an apparatus which provides the force required to ensure that the ribbon cable is maintained in position, thereby providing for a positive electrical connection, as well as proper spacing of the individual conductors of the cable

SUMMARY OF THE INVENTION

The invention is directed to an apparatus for o positioning conductors of a cable in recesses of a housing. The apparatus has a frame which has a staking member mounted thereon. A cutting member is also mounted on the frame, such that the cutting member is movable relative to the staking member. A support member is provided on the frame and is movable between a first position and a second position. When the support member is provided in the first position, the support member cooperates with the staking means to insure that the staking means is not movable relative to the frame. Alternatively, when the support member is in the second position, the support member does not cooperate with the staking member, thereby allowing the staking member to move relative to the frame.

A method is also disclosed for insuring that conductors of a ribbon cable are maintained in a recess of a housing. The conductors of the cable are positioned in respective recesses of the housing. The walls of the recesses are then deformed, causing the material of the walls to cooperate with the conductors to retain the conductors in position relative to the housing. The ends of the conductors are then cut and formed into the recesses.

DETAILED DESCRIPTION OF THE INVENTION

Figure 1:
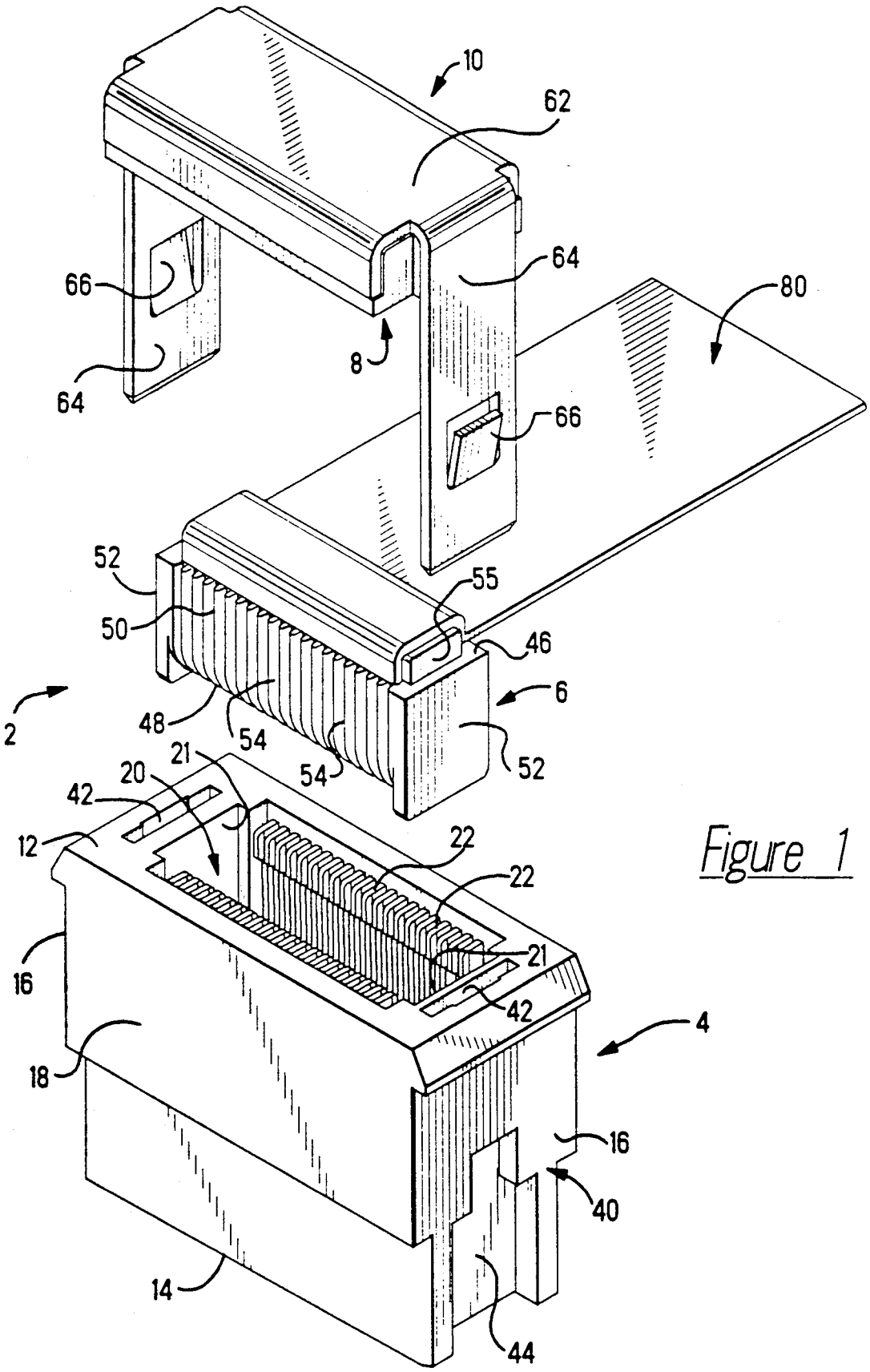
FIG. 1 is an exploded view of a connector assembly used to terminate flat cable, a cable alignment bar and a strain relief member are exploded from the housing of the connector.
Figure 2:
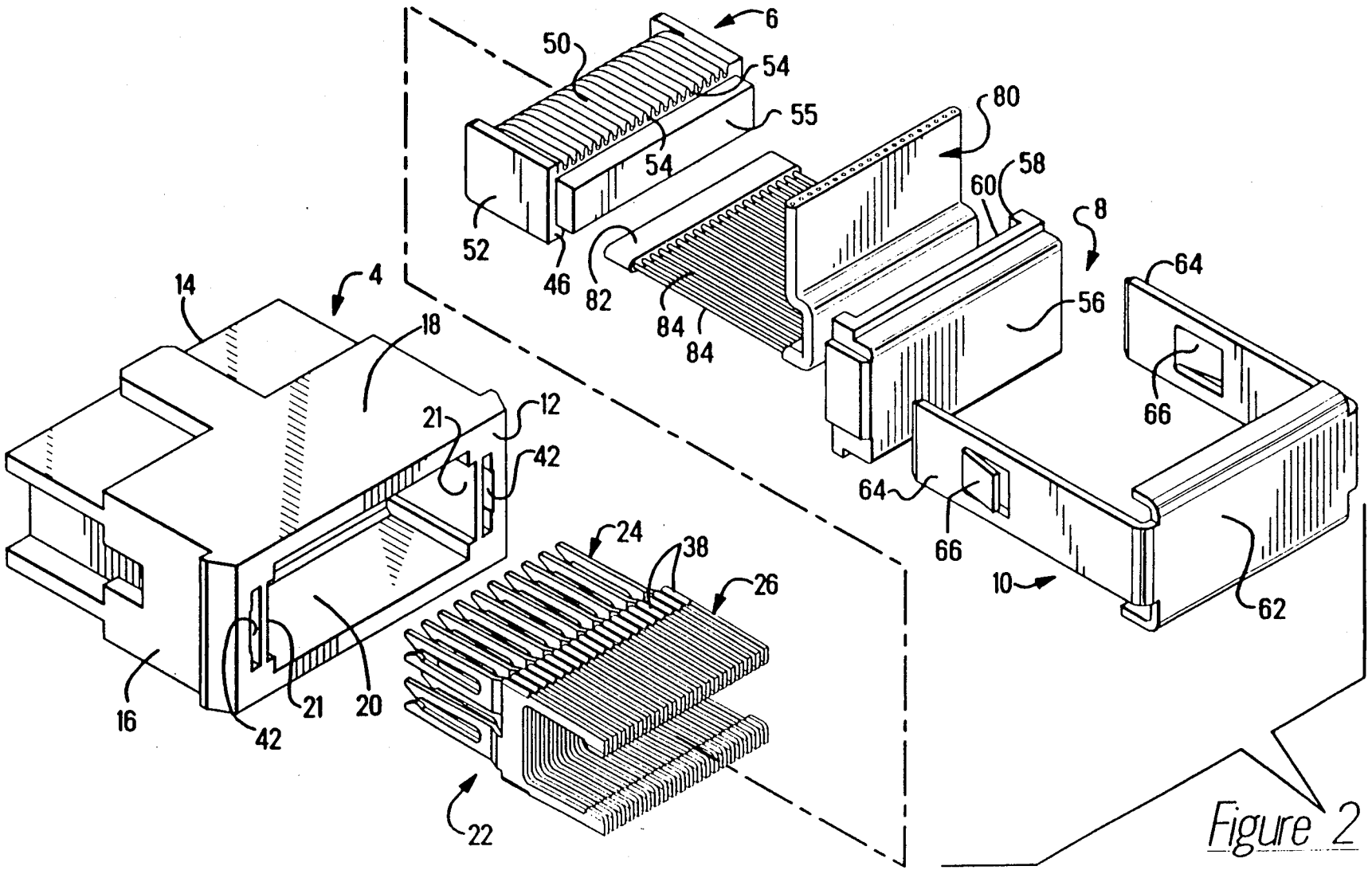
FIG. 2 is an exploded perspective view of the connector assembly, similar to that of FIG. 1, with terminals and a cable exploded from respective portions of the connector assembly.

As best illustrated in FIGS. 1 and 2, cable receiving connector assembly 2 has a housing 4, a molded alignment bar 6, a molded liner 8, and a strain relief member 10. The housing 4 has a first major surface 12 and an oppositely facing second major surface 14. End walls 16 and side walls 18 extend from the first major surface 12 to the second major surface 14. A recess 20 is positioned in the housing 4, and extends from the first major surface 12 toward the second major surface 14. The recess 20 is dimensioned to receive a plurality of terminals 22 therein, as will be more fully discussed. Positioned at either end of the recess 20, are channels 21.

Figure 3:
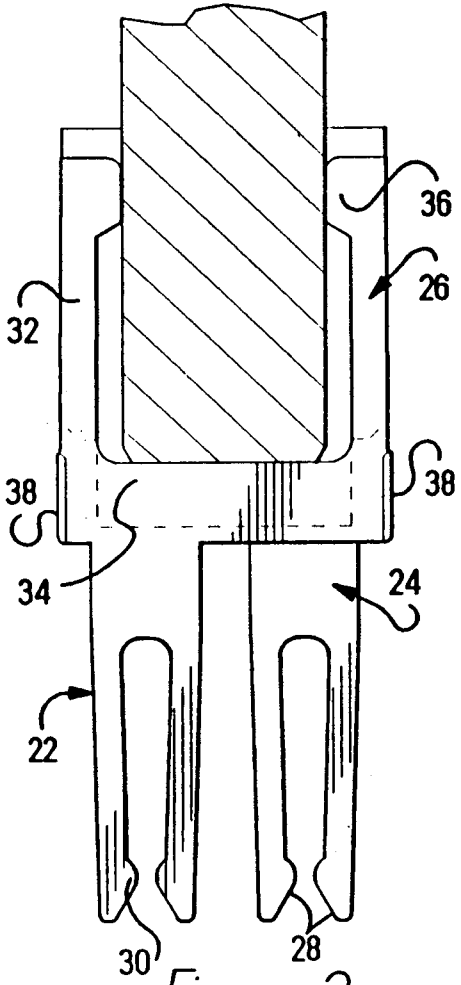
FIG. 3 is a cross-sectional view of an alignment tool used in conjunction with the connector assembly, showing a respective terminal in engagement with the alignment tool.

The terminals 22, as best shown in FIG. 3 have pin receiving sections 24 and cable receiving sections 26. The pin receiving sections 24 are provided proximate the second major surface 14 when the terminals are inserted into the housing. Lead-in surface 28 and contact areas 30 cooperate with a pin of a mating connector to insure that the terminals 22 are placed in electrical engagement with the pins of the mating connector. The cable receiving sections 26 have generally U-shaped configurations, with resilient arms 32 extending from the base portions 34 in a direction toward the first major surface 12. Provided proximate the free ends of the resilient arms 32 are contact portions 36. The contact portions 36 extend inward from the resilient arms 32, as shown in FIG. 3. Base portions 34 have sharp outer edges 38. These outer edges cooperate with the dielectric material of the relative to the housing 4. It should be noted that in the particular embodiment shown, the terminals 22 are 0.010 inches thick and the center line spacing between the terminals is 0.01968 inches.

Referring to FIGS. 1 and 2, strain relief retention sections 40 are provided on either end wall 16 of the housing 4. The strain relief sections 40 have openings 42 which extend from the first major surface 12 of the housing toward the second major surface 14. Recesses 44 are positioned adjacent to the openings 42, and cooperate therewith.

Alignment bar 6 is dimensioned to be received in the recess 20 of the housing 4. The alignment bar has a first surface 46 and a generally rounded second surface 48. Side walls 50 and end walls 52 extend from the first surface 46 to the second surface 48. Conductor receiving recesses 54 extend from the first surface 46, along a respective side surface, across the rounded second surface 48, and back toward the first surface, to form recesses into which the individual conductors of the cable can be manipulated and retained in position. Each end wall 52 is configured to be accepted into the cavities 21 provided on the housing 4, thereby providing the means required to insure that the ribbon cable remains in electrical engagement with the terminals of the connector.

The first surface 46 has a bar projection 55 which extends therefrom. The bar projection 55 extends in a direction away from the second surface 48, and cooperates with the cable when the cable is inserted onto the alignment bar.

The molded liner 8, as best shown in FIG. 2, has a relatively flat upper surface 56 and a lower surface 58 which has a recess 60 provided therein. The recess is dimensioned to allow the bar projection 54 and a cable 80 to be provided therein.

The strain relief member 10 is made of stainless steel or some other material having the strength characteristics required. the strain relief member has a hold down plate 62 which has locking arms 64 which extend from opposed ends thereof. The locking arms 64 have resilient securing projections 66 which are provided thereon.

In operation, the terminals 22 are properly positioned in the recess 20. The alignment bar 6 is then moved into the recess 20. However, before the alignment bar is moved into the recess, a respective cable 80 must be positioned and maintained on the alignment bar.

Figure 9:
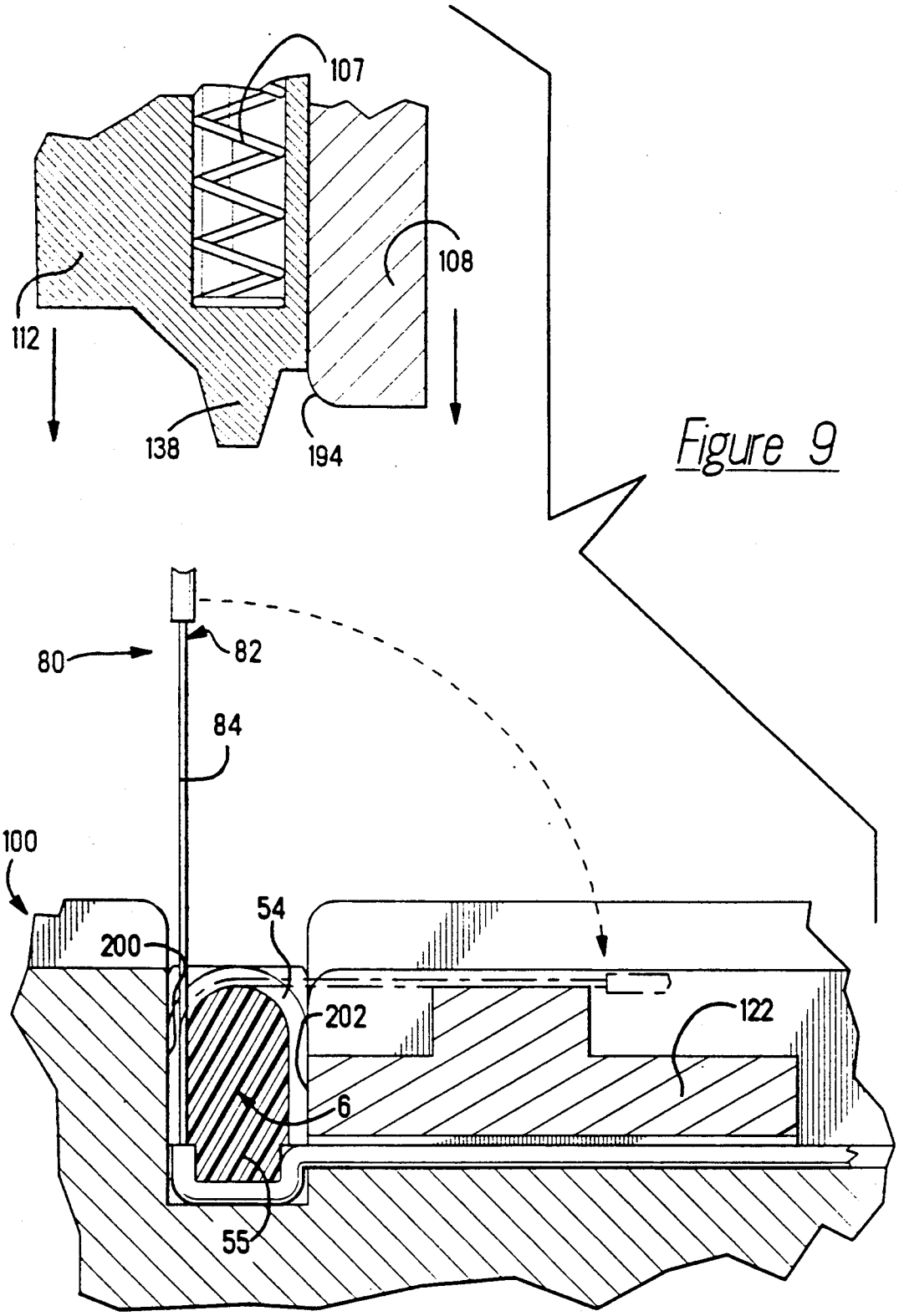
FIG. 9 is an enlarged cross-sectional view of a termination area of the apparatus of FIG. 6, showing the movement of the alignment bar and the cable from the initial position to the preinsertion position.

Referring now to FIG. 9, the preparation and positioning of the cable 80 on the alignment bar will now be discussed. Ends 82 of the cable are stripped by means of laser burning or other known methods. This type of process insures that residue will not be left between the stripped portions of the conductors of the cable. It may be worth noting that a small piece of insulation remains at the end of the conductors. This insures that the proper spacing will be maintained between the conductors until the conductors are positioned in the recesses of the alignment bar 6.

With the end 82 of the cable prepared, the alignment bar 6 is moved into cooperation with the prepared end 82 of the cable, as is illustrated in FIG. 2. The configuration of the cable is obtained during the laser burning process, and consequently, no reworking of the cable takes place in this step. As is shown, the bar projection 55 of the alignment bar 6 is received within a bent portion of the cable. The exposed conductors 84 of the end 82 of the cable are positioned in a portion of the conductor receiving recesses 54, thereby insuring that the spacing required between the exposed conductors is maintained.

Figure 4:
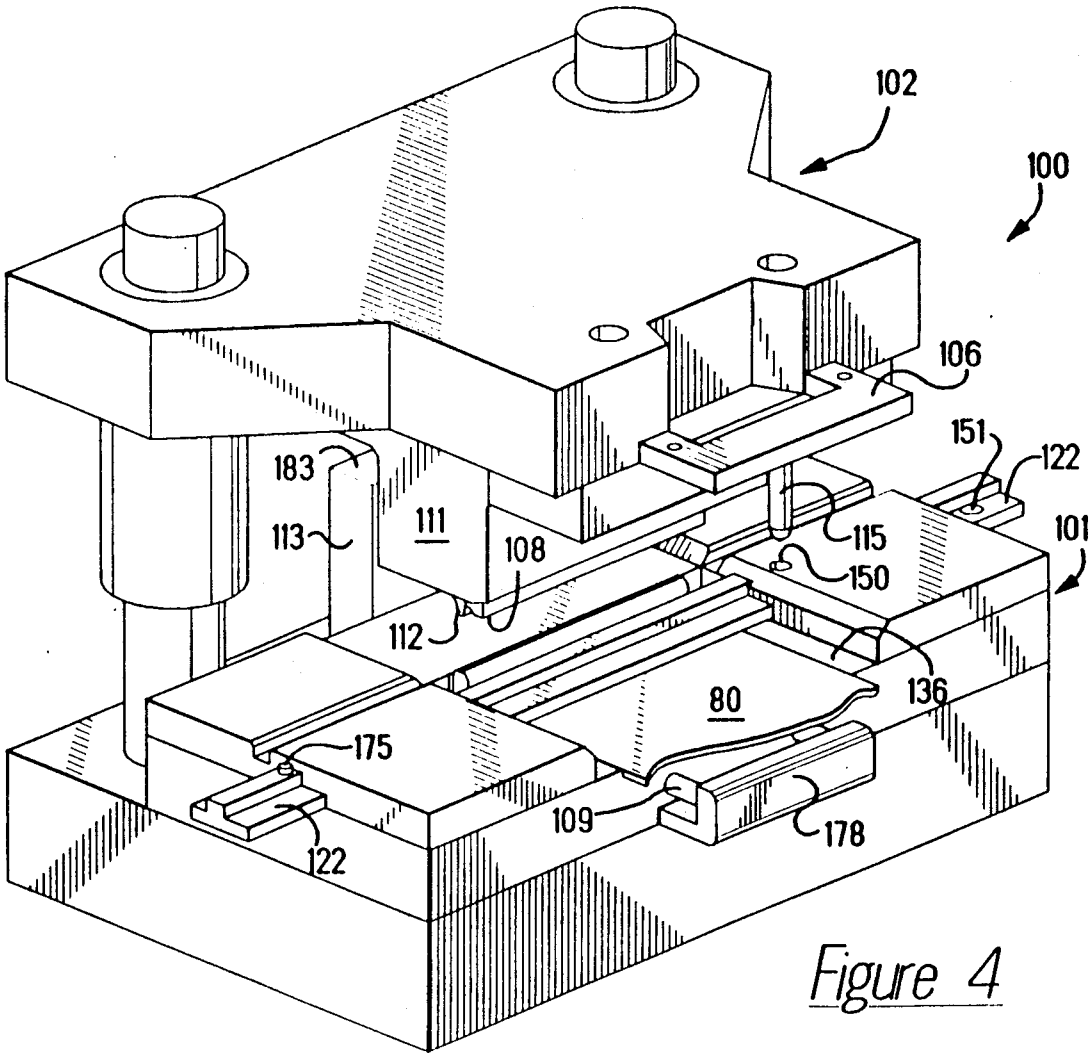
FIG. 4 is a perspective view of an apparatus for terminating the cable to the alignment bar of the connector.

The cable and alignment bar subassembly is positioned in an assembly tool 100. The assembly tool 100, as best shown in FIG. 4, has a stationary lower frame member 101 and a movable upper frame member 102. The upper frame member being movable toward and away from the lower frame member.

Referring to FIGS. 5 through 8, the upper frame member 102 has a guide block 111, a staking block 112, and a laminated subassembly 108 which extend therefrom, in a direction toward the lower frame member 101. The guide block 111 and the laminated subassembly 108 are fixedly mounted to the upper frame member 102, such that as the upper frame member is moved relative to the lower frame member, the guide block 111 and the laminated subassembly 108 are moved accordingly.

Figure 5:
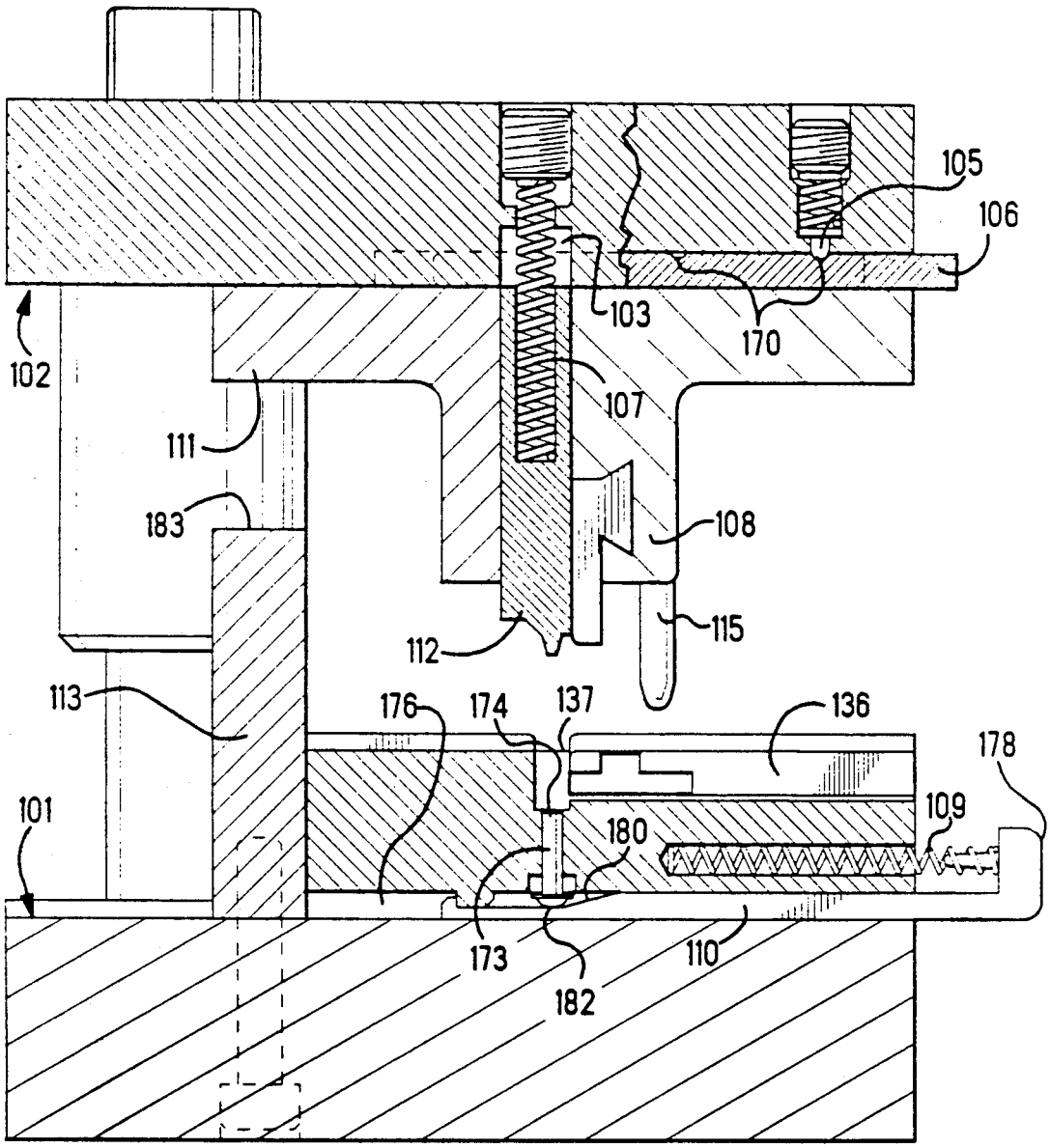
FIG. 5 is a cross-sectional view of the apparatus shown in FIG. 4, the apparatus is provided in an open or first position.

The staking block 112 is positioned between the guide block and the laminated subassembly, and is mounted to the frame member 102 by a spring 107 (FIG. 5). This allows the staking block to move independently of the frame member 102. A recess 103 is provided in the upper frame member 102. The recess is aligned with the staking block 112, such that as the staking block is moved upward with respect to the frame member, the staking block will be partially positioned in the recess. It is worth noting that the staking block 112 may be manipulated to operate in the same manner as the guide block and laminated subassembly, as will be more fully discussed.

A pilot pin 115 also extends from the upper frame member 102 in a direction toward the lower frame member 101. The pin 115 is positioned proximate the laminated subassembly.

Figure 6:
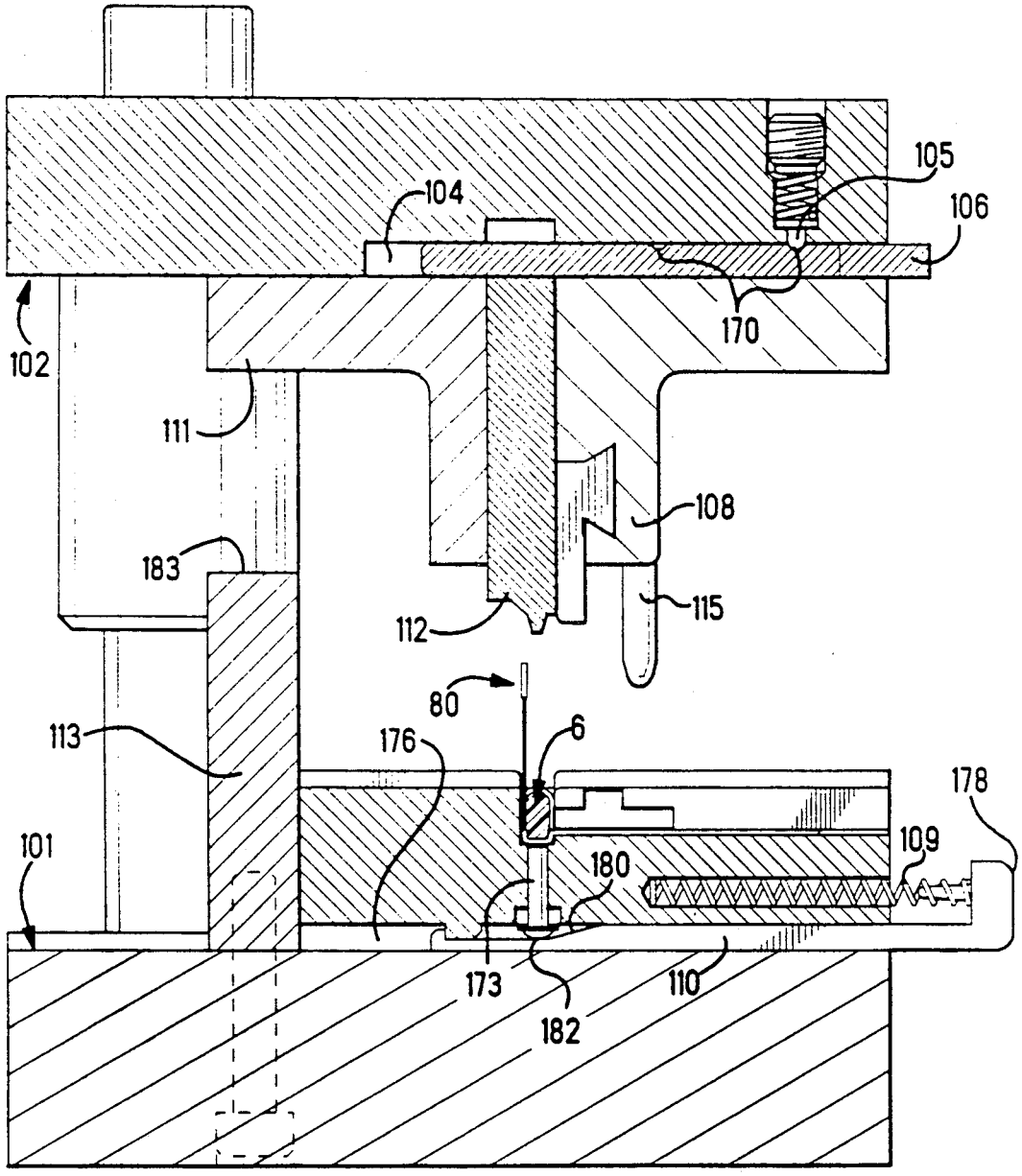
FIG. 6 is a cross-sectional view of the apparatus showing the apparatus in the open position with a respective alignment bar and cable positioned therein.
Figure 7A:
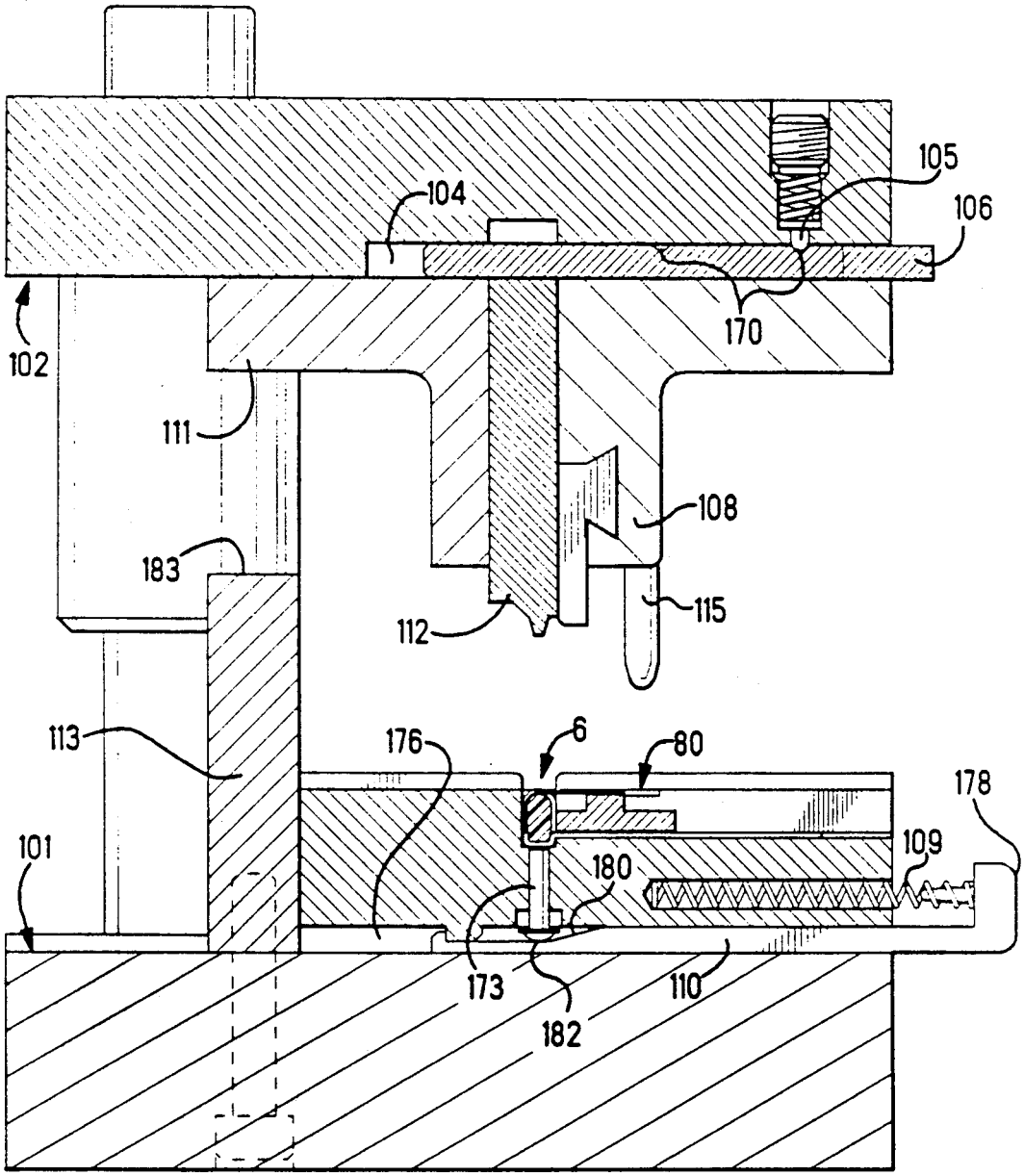
FIG. 7A is a cross-section view of the apparatus, similar to that shown in FIG. 6, showing the end of the cable bent to a preinsertion position.
Figure 7B:
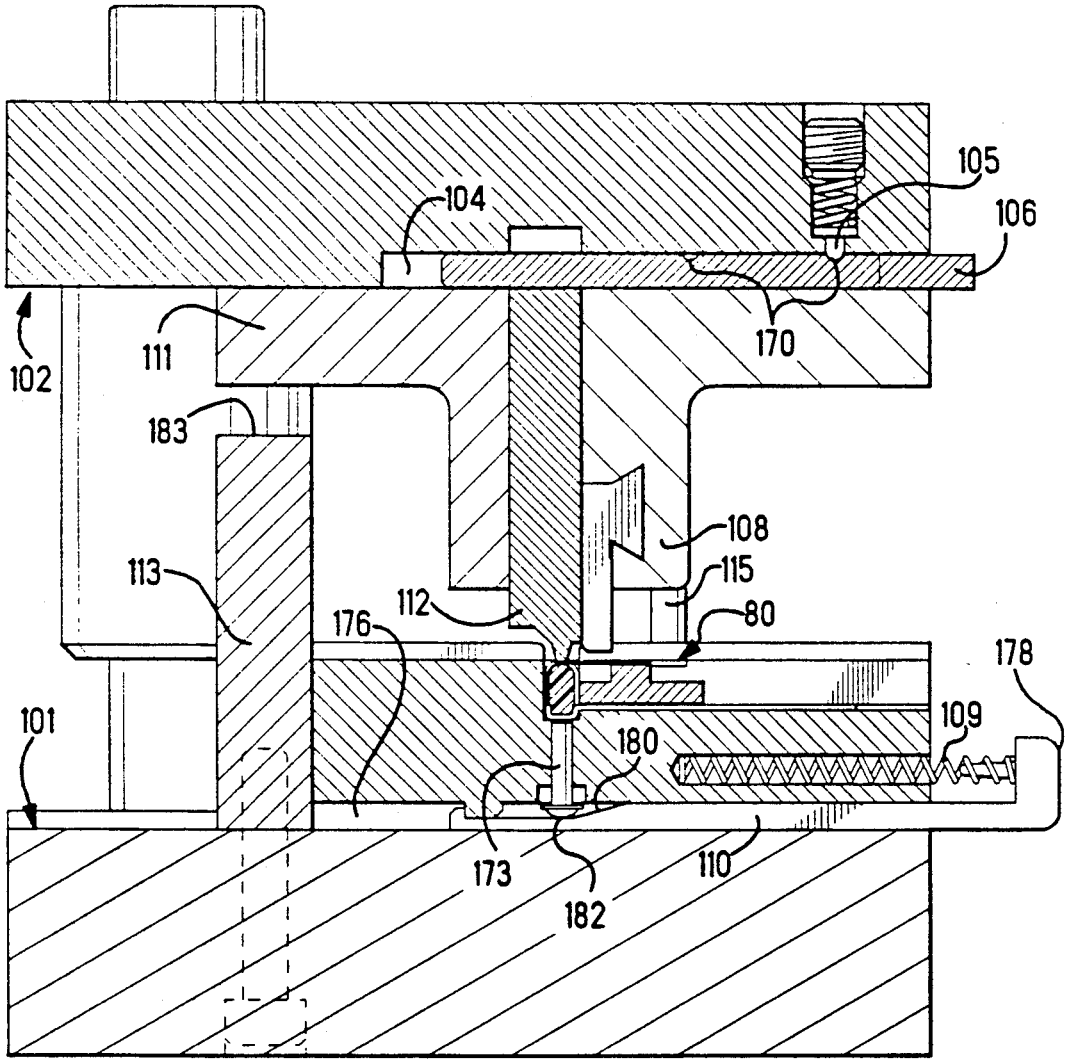
FIG. 7B is a cross-sectional view of the apparatus similar to that shown in FIG. 7A showing the apparatus in a second or partially closed position.
Figure 8:
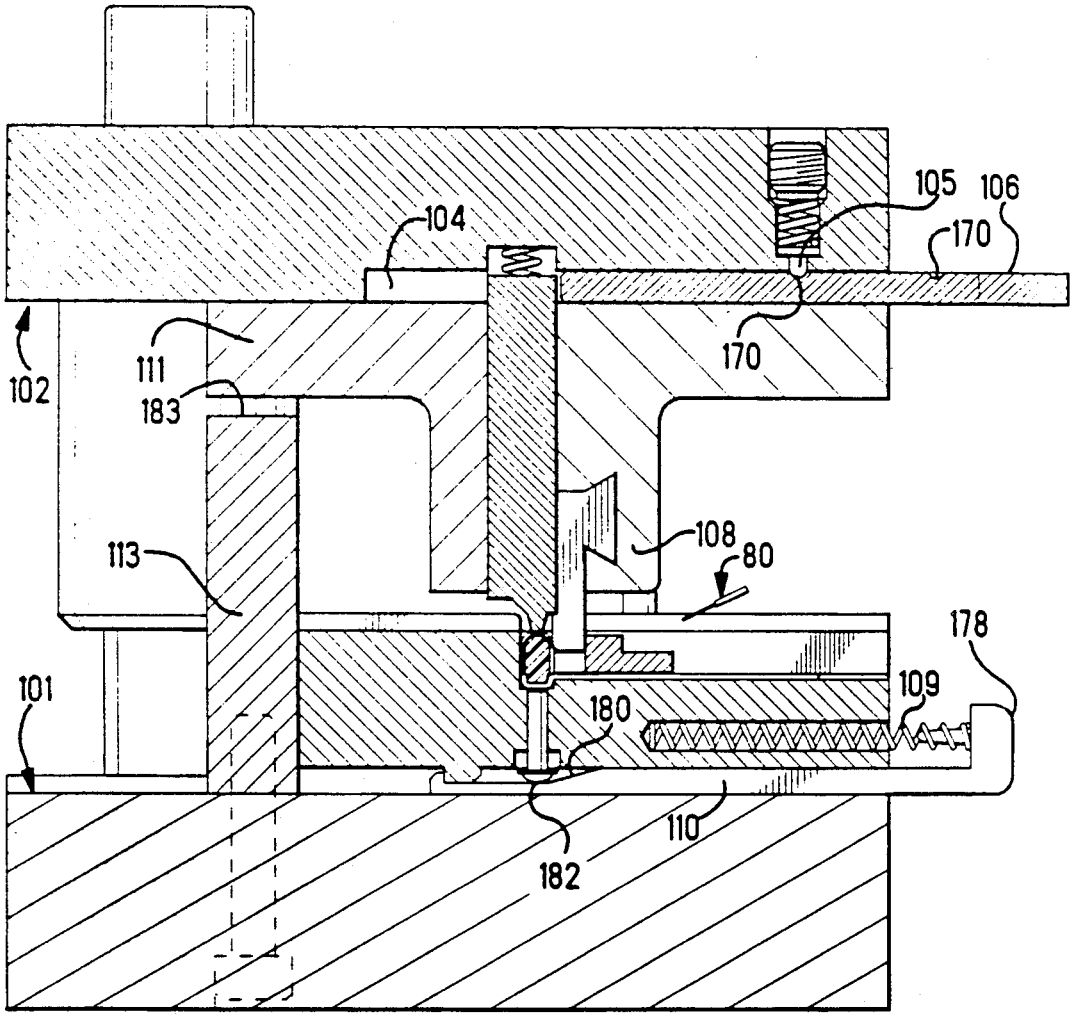
FIG. 8 is a cross-sectional view of the apparatus, similar to that shown in FIG. 7B, showing the apparatus in a third or fully closed position.

A U-shaped support member 106 is positioned in a cavity 104 provided in the upper frame member 102. As best illustrated in FIGS. 6 through 8, the support member 106 is movable between a first position and a second position. Detents 170 are provided on the support member. The detents cooperate with a spring loaded pin 105 which extends into the cavity 104. The cooperation of the pin 105 with the detents 170 define the first and the second positions.

The lower frame member 101 has a recess 137, as shown in FIG. 5, provided at an end of a cable insertion area 136. The recess is dimensioned to receive and retain the connector alignment bar and cable subassembly therein. A cam bar 122 is positioned proximate the recess 137 and extends in a direction which is essentially parallel to the longitudinal axis of the recess. The cam bar 122 extends through cam guides 121 and is movable between an open position and a closed position. A spring loaded positioning pin (not shown) is positioned in the lower frame member to cooperate with detents 172 provided on the cam bar 122. The cooperation of the positioning pin (which acts in a similar manner as spring pin 105) and the detents 172 provides a positive means to insure that the cam bar is in the position desired, as well as a positive retention means to insure that the cam bar will not have unwanted movement.

A plurality of lifter pins 173 are positioned below the recess 137, the lifter pins 173 being movable from a first position to a second position. Free ends 174 of the pins 173 are positioned below the recess when the pins are in the first position. In the second position, the free ends of the pins are positioned in the recess. A lifter cam 110 extends in a camming recess 176 provided in the lower frame member 101. The lifter cam 110 has an external handle member 178 and a sloped surface 180. The sloped surface 180 is configured to cooperate with cam follower ends 182 of pins 173. As best shown in FIG. 5, a spring 109 is attached to the lifter cam to insure that the lifter cam will be retained in an open position.

A stop block 113 extends from the lower frame member 101 in a direction toward the upper frame member 102. A stop surface 183 is provided on the stop block, the stop surface cooperates with the guide block 111 to provide a positive stop which prevents damage to laminated blades in subassembly 108.

In operation, the cable and alignment bar subassembly is positioned in the recess 137 of lower frame member 101, and the end of the cable is bent 90 degrees, as shown in FIG. 9. In this position, as best shown in FIG. 4, the cable 80 is provided in the cable insertion area 136. As the subassembly and cable are inserted into the assembly tool 100, the cam bar 122 is positioned in an open or first position, as shown in FIG. 14.

Figure 10:
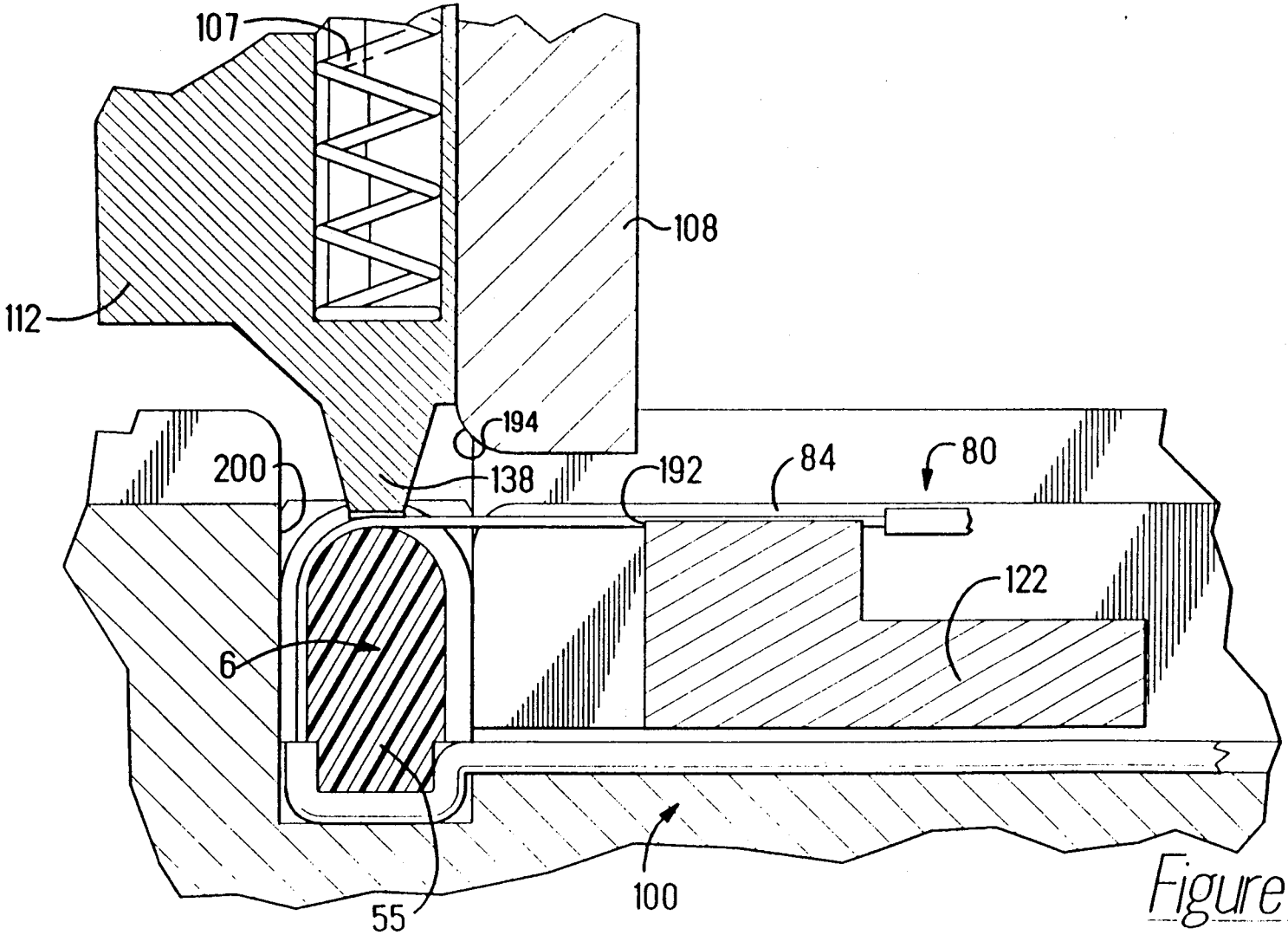
FIG. 10 is an enlarged cross-sectional view, similar to that of FIG. 9, showing the apparatus in the partially closed position.
Figure 14:
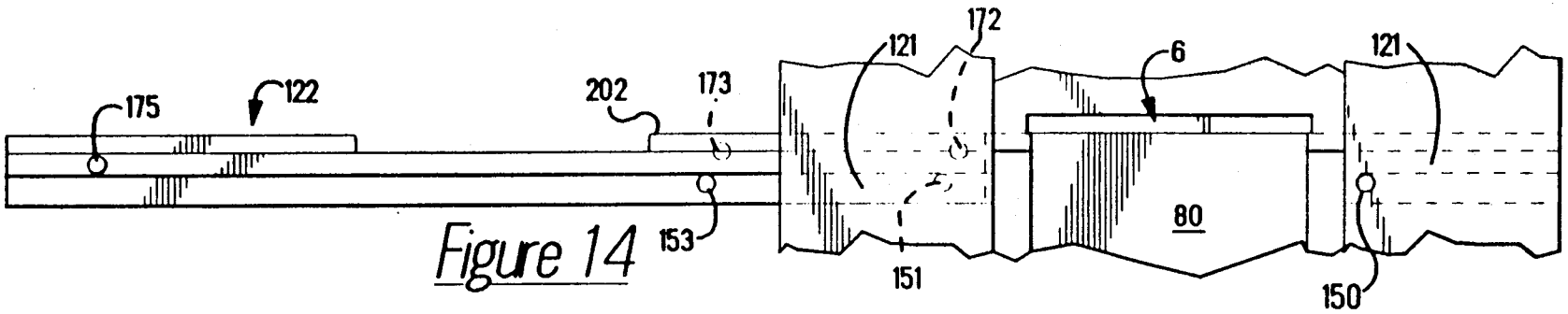
FIG. 14 is a partial view of the apparatus showing a cam bar in an open or first position.
Figure 15:
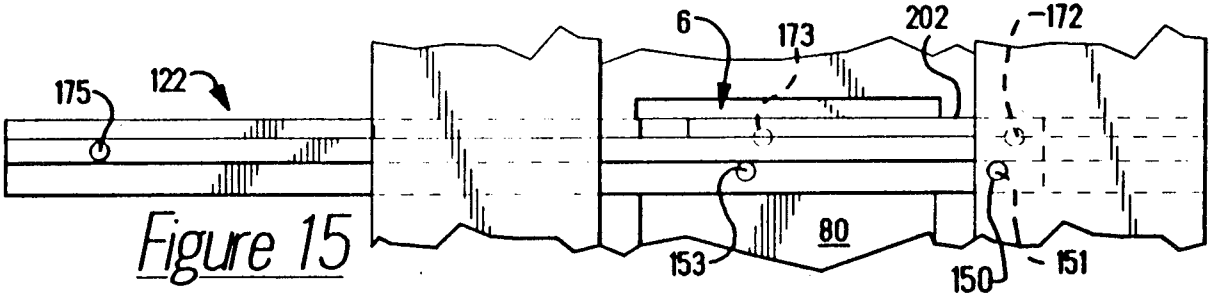
FIG. 15 is a partial view of the apparatus showing the cam bar in a second position.

When the subassembly and cable are properly positioned in recess 137 and area 136 respectively, the cam bar 122 is moved from the open position, as shown in FIG. 14, to a partially closed or second position, as shown in FIG. 15. As is shown in FIGS. 9 and 10, when the cam bar 122 is in the second position, the subassembly is maintained in position between a side wall 200 of the recess 137 and a side wall 202 of cam bar 122. The cam bar also serves to maintain the cable 80 in the area 136.

With the cam bar 122 provided in the second position, portions of the assembly tool 100 are moved through a first downstroke. During this first downstroke, the staking block 112 is locked to provide a solid non-flexible member. The staking block 112 is locked by support member 106, as shown in FIG. 6. With the support member 106 provided in the first position, the staking block 112 is prevented from moving upward relative to the upper frame 102. Consequently, the staking block 112 behaves as a solid member.

Figure 12:
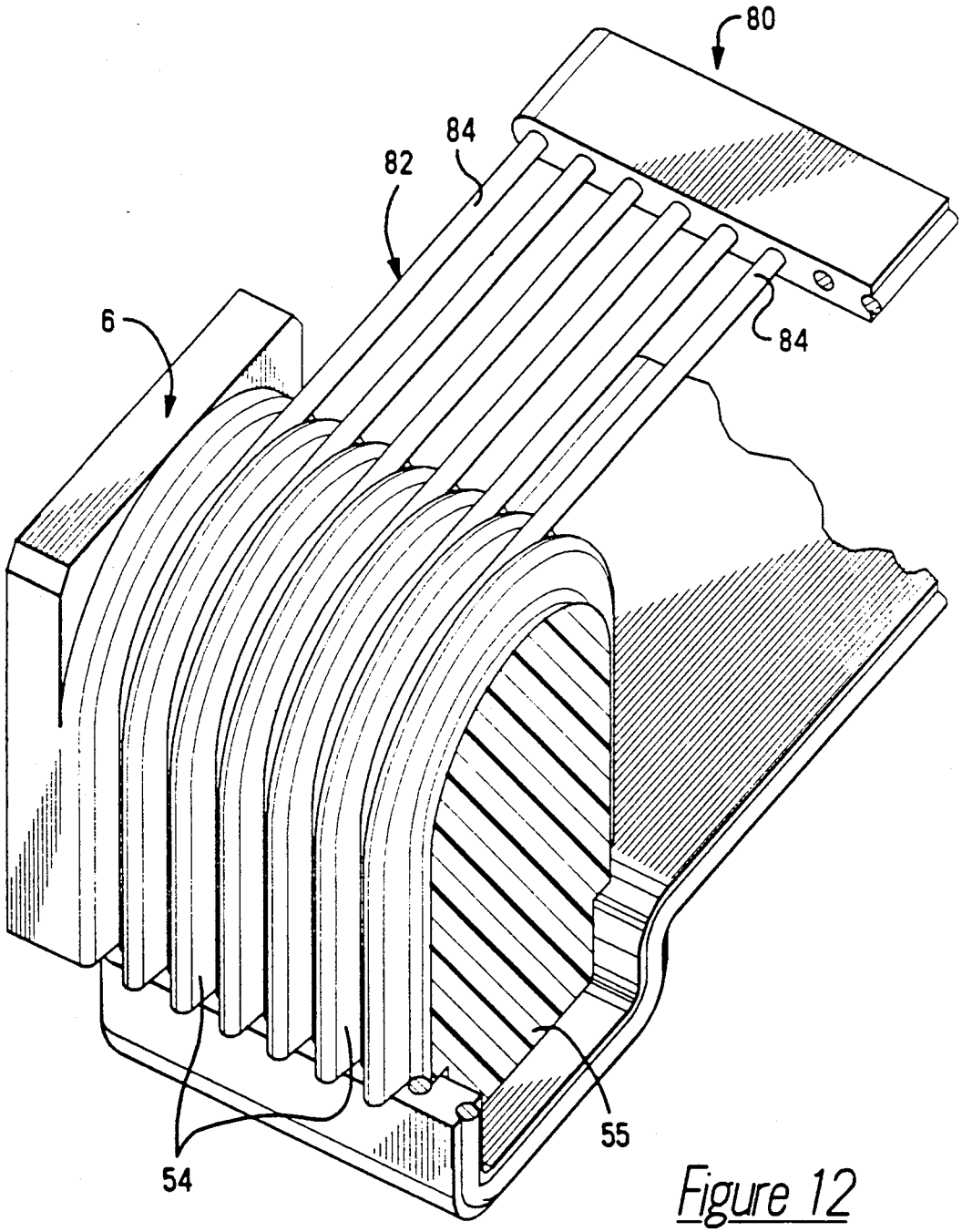
FIG. 12 is a perspective view of the cable and the alignment bar before the apparatus cooperates with the alignment bar.
Figure 13:
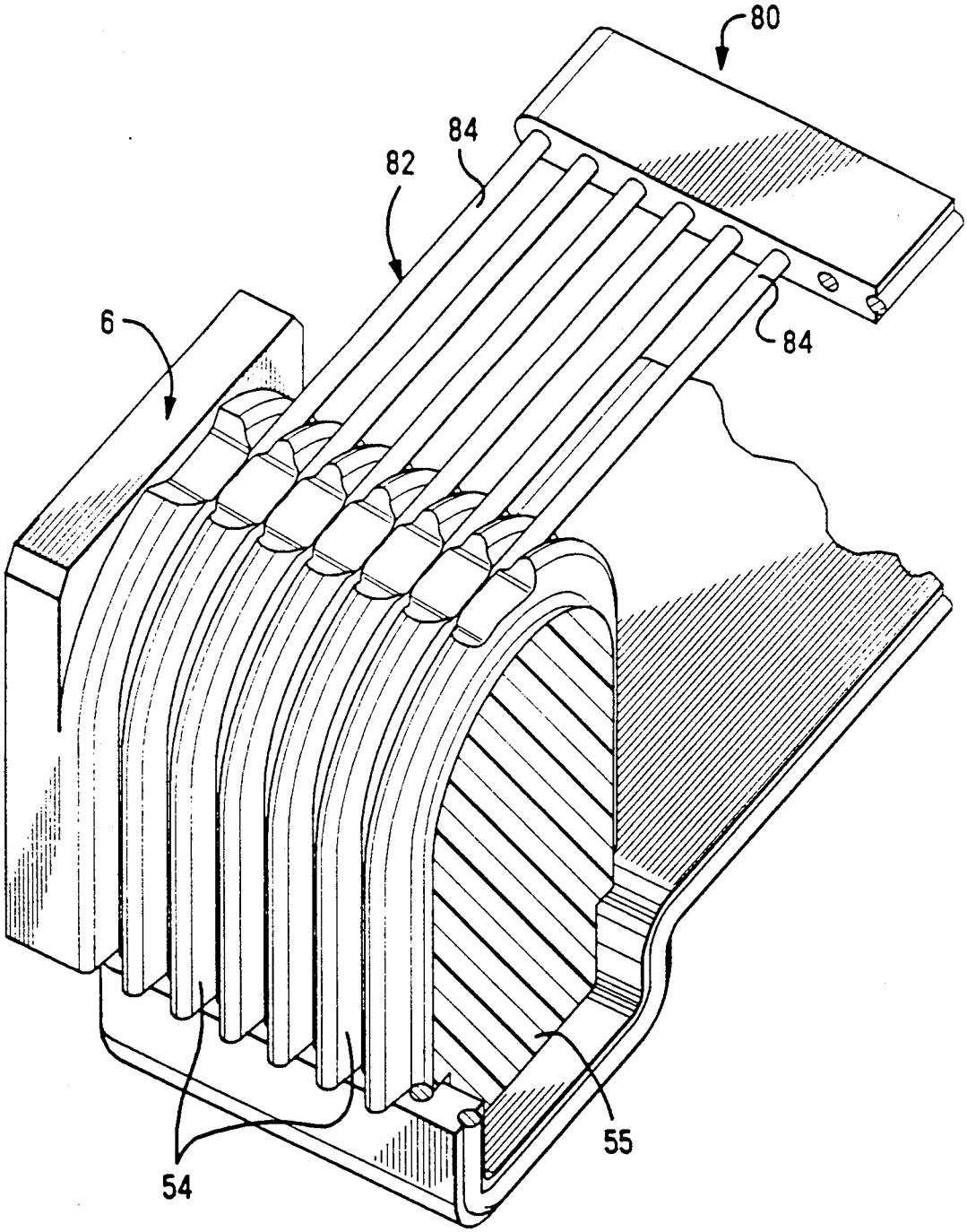
FIG. 13 is a perspective view similar to that of FIG. 12, showing the alignment bar after the apparatus has cooperated with the alignment bar.

As the upper frame 102 of the tooling 100 is lowered, the rib-like portion 138 of the staking block 112 engages the top of the cable and alignment bar. The continued downward movement of the staking block forces the staking block 112 to coin or deform the top of the walls of the bar subassembly. This deformation of the housing prevents the conductors from "spring back", which could cause misalignment. During the coining process, the individual conductors are trapped and snugly maintained in the bottom of the grooves. This process is depicted in FIGS. 12 and 13. FIG. 13 shows the configuration of the bar after the staking block has coined the tops of the walls.

It is important to note that the first downstroke can not occur unless the cam bar 122 is in the proper position, thereby providing a safety system which eliminates damage to the components. To properly position the cam bar 122 in the second position, the spring loaded pin provides a firm click stop to assure the operator that the cam bar is in the proper position. The spring loaded pin snaps into the counter-sunk detent 172 on the bottom side of the cam bar 122. In addition, during the first downstroke, a pilot pin 115 enters a clearance hole 150 and protrudes through a clearance hole 151 in the cam bar 122. If the cam bar 122 is not in the proper position, the pilot pin will hit a solid surface of the cam bar and stop the downstroke.

After the upper frame has completed the first downward stroke, the upper frame is returned to its initial position. The support member 106 is moved to the second position. Two spring loaded pins 105 provide a positive stop to insure that the support member will be maintained in the second position. With the support member in the second position, the staking block 112 operates in a resilient manner, as will be discussed below.

Figure 16:
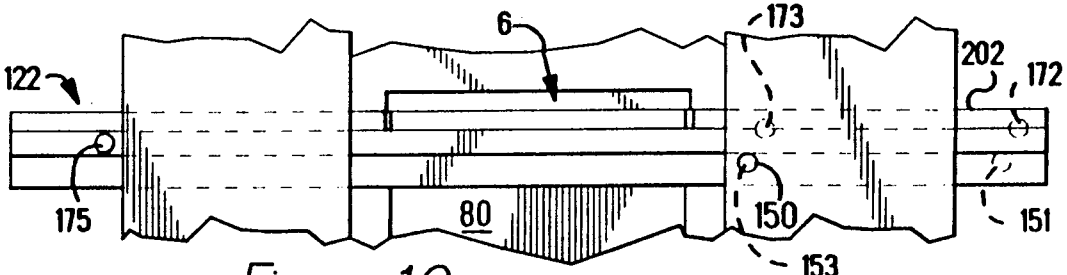
FIG. 16 is a partial view of the apparatus showing the cam bar in a closed or third position.

The cam bar 122 is moved to a fully closed or third position, as shown in FIG. 16. To properly position the cam bar 122 is the third position, the spring loaded pin provides a firm click stop to assure the operator that the cam bar is in the proper position. The spring loaded pin snaps into a counter-sunk detent 173 on the bottom side of the cam bar 122. In addition, during the second downstroke, the pilot pin 115 enters the clearance hole 150 and protrudes through a clearance hole 153 in the cam bar 122. If the cam bar 122 is not in the proper position, the pilot pin will hit a solid surface of the cam bar and stop the downstroke. It is worth noting, that the over insertion of the cam bar 122 into cam guides 121 can not occur. Projection 175 extends from the cam bar 122 and cooperates with a side wall of lower frame member 101 to prevent the over insertion of the cam bar.

Figure 11:
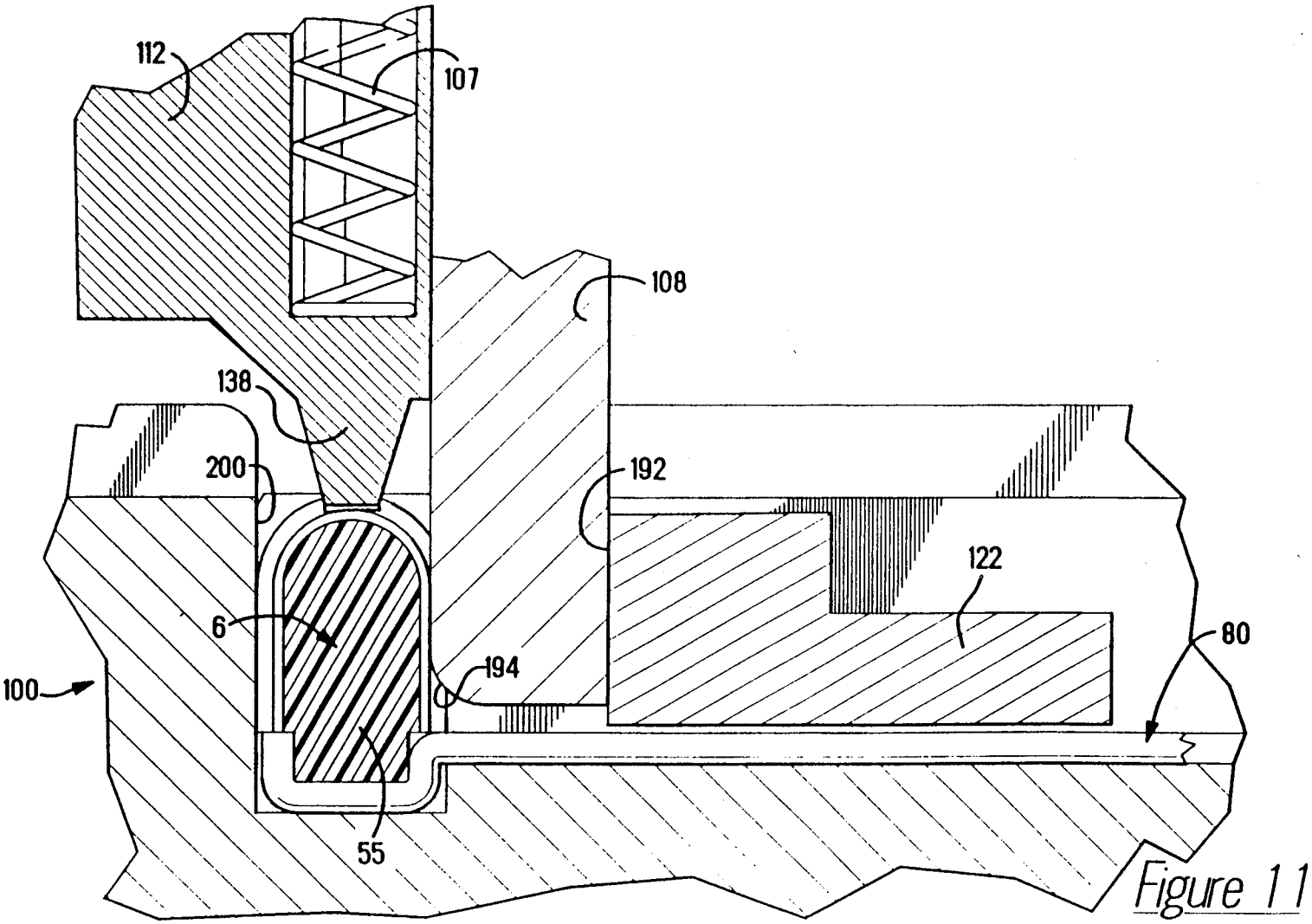
FIG. 11 is an enlarged cross-sectional view, similar to that of FIG. 10, showing the apparatus in the fully closed position.

The upper frame is lowered through a second downstroke. The laminated subassembly 108 and the staking block 112 are moved into cooperation with the conductors 84. Initially the subassembly and block 108, 112 are moved in unity toward the alignment bar 6, as shown in FIG. 10. This motion continues until the leading end of the staking block 112 engages the conductors 84 of the cable 80. As is shown in FIG. 11, the engagement of the staking block with the alignment bar 6 prevents the further downward motion of the staking block. This is because in the second downward stroke, the support member 106 is in the second position, which allows the spring 107 to cooperate with the staking block 112. Consequently, as the staking block encounters resistance on the downward stroke, the spring 107 allows the staking block to move relative to the upper frame member 102.

Referring to FIG. 11, the second downward stroke is continued, thereby forcing the laminated subassembly 108 to engage the exposed conductors 84 of the cable 80. It is important to note that recesses (not shown) are provided on the leading edge of the subassembly 108. The recesses cooperate with the respective conductors 84 to insure for the proper position of the conductors as the termination process continues.

As the subassembly is moved downward, the conductors 84 are also forced downward, as viewed in FIG. 11. This motion forces the conductors against a cutting edge 192 provided on the cam bar 122. Consequently, the extreme ends of the conductors 84 are severed from the cable.

The downward motion of the subassembly 108 is continued, causing the conductors to wrap around the alignment bar. Angled surface 194 of the subassembly 108 allows the conductors 84 to be easily wrapped around the bar 6. In order to insure that the conductors 84 are properly positioned in the conductor receiving recesses 54, channels are provided on the subassembly 108. These channels are positioned to allow the dividing walls of the recesses 54 to be inserted therein. This allows the subassembly 108 to extend into the recesses 54, thereby insuring that the conductors 84 will be properly positioned in the recesses.

With the conductors 84 properly positioned about the alignment bar 6, the subassembly 108 is retracted. The staking block 112 is retained in cooperation with the conductors until the subassembly 108 is completely removed from the ends of the conductors. This insures that the conductors will remain in position as the subassembly is retracted. Finally, the staking block 112 and the cam bar 122 are moved from the alignment bar 6 and cable 80, thereby allowing the assembled cable and alignment bar subassembly to be removed from the tool.

Referring to FIG. 1, the assembled cable and alignment bar subassembly is inserted into the recess 20 of the housing. The end walls 52 of the alignment bar 6 are received in the channels 21 of the recess 20 to insure that the alignment bar 6 is properly positioned in the recess 20 of the housing 4. As the bar 6 is inserted into the recess 20, the contact portions 36 of the terminals 22 enter the conductor receiving recesses 54 of the bar 6. It should be noted that the resiliency of the arms 32 of the terminals is adequate to compensate for any slight misalignment between the terminals 22 and the recesses 54.

As the insertion of the bar 6 into the recess 20 occurs, the contact portions 36 engage the exposed conductors 84 of the cable, causing a wiping action between the terminals and the conductor, thereby insuring that a proper electrical connection will be effected.

When the alignment bar 6 is fully inserted into the recess 20 of the housing 4, the resilient arms 32 of the terminals generate a significant force on the conductors. This insures that the alignment bar 6 will be maintained in position, and that the electrical connection between the terminals and the cable will be reliable over time.

With the alignment bar 6 properly positioned in the housing 4, the molded liner 8 and strain relief member 10 are positioned over the cable 80. the strain relief member 10 provides a means to lock the assembly together. The locking arms 64 of the strain relief member 10 are positioned in the openings 42 of sections 40 of housing 4, such that the resilient securing projections 66 are provided in the recesses 44. The cooperation of the projections 66 and recesses 44 insures that the assembly will remain in the locked position.

Connector assembly 2 is mated with a mating connector to provide the electrical path required between the cable and a printed circuit board or the like.

Changes in construction will occur to those skilled in the art and various apparently different modifications and embodiments may be made without departing from the scope of the invention. The matter set forth in the foregoing description and accompanying drawings is offered by way of illustration only.

We claim:

1. An apparatus for positioning conductors of a cable in recesses of a housing, the apparatus comprising:

a frame;

a cutting means mounted to the frame;

a staking means mounted to the frame such that the staking means are movable relative to the cutting means;

a support member positioned on the frame and movable between a first position and a second position, whereby when the support member is in the first position, the support member cooperates with the staking means to insure that the staking means is not movable relative to the frame, and when the support member is in the second position, the support member does not cooperate with the staking means, thereby allowing the staking means to move relative to the frame.

2. An apparatus as recited in claim 1 wherein the frame has a stationary lower frame member and a movable upper frame member, the upper frame member being movable toward and away from the lower frame member.

3. An apparatus as recited in claim 2 wherein the lower frame member has a housing receiving recess provided at an end of a cable insertion area, the housing receiving recess is dimensioned to receive and retain the housing and the cable therein.

4. An apparatus as recited in claim 2 wherein the upper frame member has the support member positioned in a support member receiving cavity, the support member has detents provided thereon, the detents cooperate with a spring loaded pin of the upper frame member to define the first and the second positions.

5. An apparatus as recited in claim 4 wherein the support member is U-shaped.

6. An apparatus as recited in claim 4 wherein the staking means is mounted to the upper frame member by a resilient member, whereby when the support member is in the second position, the resilient member allows the staking means to move independently of the upper frame member.

7. An apparatus as recited in claim 6 wherein the resilient member is a spring which extends from proximate a top surface of the staking means, whereby the support member cooperates with the top surface of the staking means when the support member is in the first position to prevent the staking means from movement independent of the upper frame member.

8. An apparatus as recited in claim 4 wherein the cutting means is fixedly mounted to the upper frame member.

9. An apparatus as recited in claim 7 wherein a cam bar is provided in cam guides, the cam guides are positioned in the lower frame member proximate a housing receiving recess, the cam bar is movable between an open position and a closed position.

10. An apparatus as recited in claim 9 wherein the cam bar has detents provided thereon, the detents cooperate with a spring loaded positioning pin to provide a positive positioning means to insure that the cam bar is maintained in the desired position.

11. An apparatus as recited in claim 10 wherein a pilot pin extends from the upper frame member in a direction toward the lower frame member, a first clearance opening is provided on the lower frame member, and a second clearance opening is provided on the cam bar, whereby when the pilot pin, the first clearance opening, and the second clearance opening are aligned, the upper frame member can be moved through a first downstroke.

12. An apparatus as recited in claim 11 wherein a third clearance opening is provided on the cam bar, whereby when the pilot pin, the first clearance opening, and the third clearance opening are aligned, the upper frame member can be moved through a second downstroke.

13. An apparatus as recited in claim 3 wherein a lifter cam is provided proximate the housing receiving recess to cooperate with the housing to remove the housing from the housing receiving recess.

14. An apparatus for positioning conductors of a cable in recesses of a housing, the apparatus comprising:

a frame;

a movable means provided on the frame, the movable means having a first member and a second member;

the first member mounted to the frame such that the first member is movable relative to the second member;

a support member positioned on the frame and movable between a first position and a second position, whereby when the support member is in the first position, the support member cooperates with the first member to insure that the first member is not movable relative to the frame, and when the support member is in the second position, the support member does not cooperate with the first member, thereby allowing the first member to move relative to the frame.

15. An apparatus as recited in claim 14 wherein the frame has a stationary lower frame member and a movable upper frame member, the upper frame member is movable toward and away from the lower frame member, the movable means is provided on the upper frame member.

16. An apparatus as recited in claim 15 wherein a cam bar is provide in cam guides, the cam guides are positioned in the lower frame member proximate a housing receiving recess, the cam bar is movable between an open position and a closed position.

17. An apparatus as recited in claim 16 wherein the cam bar has detents provided thereon, the detents cooperate with a spring loaded positioning pin to provide a positive positioning means to insure that the cam bar is maintained in the desired position.

18. An apparatus as recited in claim 17 wherein a pilot pin extends from the upper frame member in a direction toward the lower frame member, a first clearance opening is provided on the lower frame member, and a second clearance opening is provided on the cam bar, whereby when the pilot pin, the first clearance opening, and the second clearance opening are aligned, the upper frame member can be moved through a first downstroke.

19. An apparatus as recited in claim 18 wherein a third clearance opening is provided on the cam bar, whereby when the pilot pin, the first clearance opening, and the third clearance opening are aligned, the upper frame member can be moved through a second downstroke.

* * * * *